US010820702B1

(12) United States Patent
Lin

(10) Patent No.: US 10,820,702 B1
(45) Date of Patent: Nov. 3, 2020

(54) CHAIR SEAT SLIDING AND LOCKING MECHANISM

(71) Applicant: Chang-Chen Lin, Tainan (TW)

(72) Inventor: Chang-Chen Lin, Tainan (TW)

( * ) Notice: Subject to any disclaimer, the term of this patent is extended or adjusted under 35 U.S.C. 154(b) by 0 days.

(21) Appl. No.: 16/535,189

(22) Filed: Aug. 8, 2019

(51) Int. Cl.
*A47C 1/03* (2006.01)
*A47C 16/02* (2006.01)
*A47C 1/032* (2006.01)

(52) U.S. Cl.
CPC ..... *A47C 1/0325* (2013.01); *A47C 1/03294* (2013.01)

(58) Field of Classification Search
CPC ..... A47C 1/03255; A47C 1/03294; A47C 1/0325; A47C 1/03238; A47C 7/46; A47C 1/03233
USPC ..... 297/317
See application file for complete search history.

(56) References Cited

U.S. PATENT DOCUMENTS 2,400,588 A * 5/1946 McArthur ..... A47C 1/03238 297/317
2,560,985 A * 7/1951 Rideout ..... A47C 1/0325 297/82
3,074,759 A * 1/1963 Bergenwall ..... A47C 1/03238 297/318
3,947,069 A * 3/1976 Lusch ..... A47C 1/0325 297/317
5,211,444 A * 5/1993 Kjellman ..... A47C 1/0325 297/375
7,407,229 B1 * 8/2008 Chen ..... A47C 1/143 297/259.2
7,735,925 B2 6/2010 Lin
8,534,758 B2 * 9/2013 Rivera ..... A47C 3/00 297/342
9,717,340 B2 * 8/2017 Rivera ..... A47C 1/03294

* cited by examiner

*Primary Examiner* — Shin H Kim
(74) *Attorney, Agent, or Firm* — Alan D. Kamrath; Mayer & Williams PC

(57) ABSTRACT

A chair seat sliding and locking mechanism includes a positioning tube and a sliding seat. The positioning tube is mounted to a rod of a chair base. The positioning tube is rotatable relative to the rod but is not longitudinally slidable. The sliding seat includes a coupling portion securely coupled with a chair seat. The coupling portion includes a receiving portion having a receiving hole with a catching portion. The positioning tube is received in the receiving hole. When the positioning tube is rotated relative to the rod to a first position in which a positioning portion of the positioning tube disengages from the catching portion, the sliding seat is movable along the positioning tube. When the positioning tube is rotated relative to the rod to a second position in which the positioning portion engages with the catching portion, the sliding seat is fixed relative to the positioning tube.

6 Claims, 6 Drawing Sheets

CHAIR SEAT SLIDING AND LOCKING MECHANISM

BACKGROUND OF THE INVENTION

The present invention relates to a chair seat sliding and locking mechanism and, more particularly, to a mechanism for reliably locking a chair seat in a desired position.

Conventional leisure chairs permitting position adjustment for sitting and lying generally include a rod fixed on a base. A locking mechanism is slidably mounted on the rod and is coupled with a chair seat. The chair seat can be moved through adjustment, and the locking mechanism can move along the rod. When the chair seat reaches a desired position, the locking mechanism and the rod are fixed to position the chair seat. The backrest is also moved together with the chair seat, such that the sitting angle or lying angle can be adjusted.

Conventional locking mechanisms are generally fixed by turning a knob to press against the rod, which is inconvenient and not always reliable in positioning if the knob is not rotated to a tightened state. Furthermore, when the knob is turned loose, the backrest in a reclined state is liable to recline to its maximum reclining angle under the gravitational force, leading to inconvenient adjustment in the angular position.

In an arrangement to overcome the above disadvantages, a positioning device includes a clamping seat, a positioning block, an adjusting rod, and a coupling mechanism. The clamping seat can move together with a chair seat and includes a hole receiving a fixed rod on the chair seat. The clamping seat further includes first and second clamping members movable relative to each other between an open state and a clamping state. The positioning block is mounted on the clamping seat. The adjusting rod is coupled to a side of the positioning block by the coupling mechanism. Thus, the adjusting rod can pivot to move the first and second clamping members to the open state, permitting the chair seat and the clamping seat to slide along the fixed rod. When the seat reaches the desired position, the adjusting rod is pivoted to move the first and second clamping members to the clamping state, thereby locking the clamping seat and the chair seat in place. An example of this arrangement is disclosed in U.S. Pat. No. 7,735,925.

However, the adjusting rod displaces when the chair seat and the clamping seat move, such that the hand of a user cannot control the adjusting rod according to the habitual position. Furthermore, when the clamping seat is moved to a front position permitting the user to lie down, the user may have to get up to grip the adjusting rod that has moved to the front position, causing inconvenience in use.

BRIEF SUMMARY OF THE INVENTION

An objective of the present invention is to provide a chair seat sliding and locking mechanism providing improved operational convenience and improved locking stability.

A chair seat sliding and locking mechanism according to the present invention includes a positioning tube and a sliding seat. The positioning tube is configured to be mounted to a rod of a base of a chair having a chair seat. The positioning tube is rotatable relative to the rod but is not slidable relative to the rod along a longitudinal axis of the rod. The positioning tube includes a positioning portion. The sliding seat includes a coupling portion coupled with the chair seat, permitting joint movement of the sliding seat and the chair seat. The coupling portion includes a receiving portion having a receiving hole with a catching portion. The positioning tube is received in the receiving hole. When the positioning tube is rotated relative to the rod to a first position in which the positioning portion disengages from the catching portion, the sliding seat is movable along the positioning tube. When the positioning tube is rotated relative to the rod to a second position in which the positioning portion engages with the catching portion, the sliding seat is fixed relative to the positioning tube.

In an example, the positioning portion protrudes outwards from an outer periphery of the positioning tube and extends in an axial direction. The receiving hole of the sliding seat includes a recessed portion corresponding to the positioning portion of the positioning tube. The catching portion is disposed at a side of the receiving hole corresponding to the recessed portion.

Thus, the positioning portion of the positioning tube can be moved to a position aligned with the recessed portion of the sliding seat and disengages from the catching portion, permitting adjustment of the position of the sliding seat. On the other hand, when the positioning portion of the positioning tube engages with the catching portion by turning the positioning tube to another position, the position of the chair seat is fixed. Accordingly, the operation is simple. The chair seat can be pivotably coupled with a backrest, such that the reclining angle of the backrest can be adjusted while adjusting the position of the chair seat.

In an example, the positioning portion of the positioning tube includes a first toothed portion extending in the axial direction. The first toothed portion includes a plurality of first teeth. Each of the plurality of first teeth has a tip tangent to the positioning tube. The catching portion of the sliding seat includes a second toothed portion engageable with the first toothed portion. The second toothed portion includes a plurality of second teeth engageable with the plurality of first teeth.

In an example, the positioning tube includes a handle extending radially from an outer side of the positioning tube. The handle can be operated to rotate the positioning tube. When the positioning portion engages with the catching portion, the first teeth of the first toothed portion engage with the second teeth of the second toothed portion, which provides a better positioning effect than conventional mechanisms by friction. Thus, the positions of the sliding seat and the chair seat and the reclining angle of the reclining angle can be reliably retained.

During adjustments where the sliding seat moves between different positions, the handle remains in the same position, a user can easily hold the handle according to his or her operational habit. Accordingly, the chair seat sliding and locking mechanism according to the present invention provides improved locking stability and improved operational convenience.

The present invention will become clearer in light of the following detailed description of illustrative embodiments of this invention described in connection with the drawings.

DESCRIPTION OF THE DRAWINGS

FIG. 2A is an enlarged view of a circled portion of FIG. 2.

FIG. 2B is an enlarged view of another circled portion of FIG. 2.

DETAILED DESCRIPTION OF THE INVENTION

Figure 1:
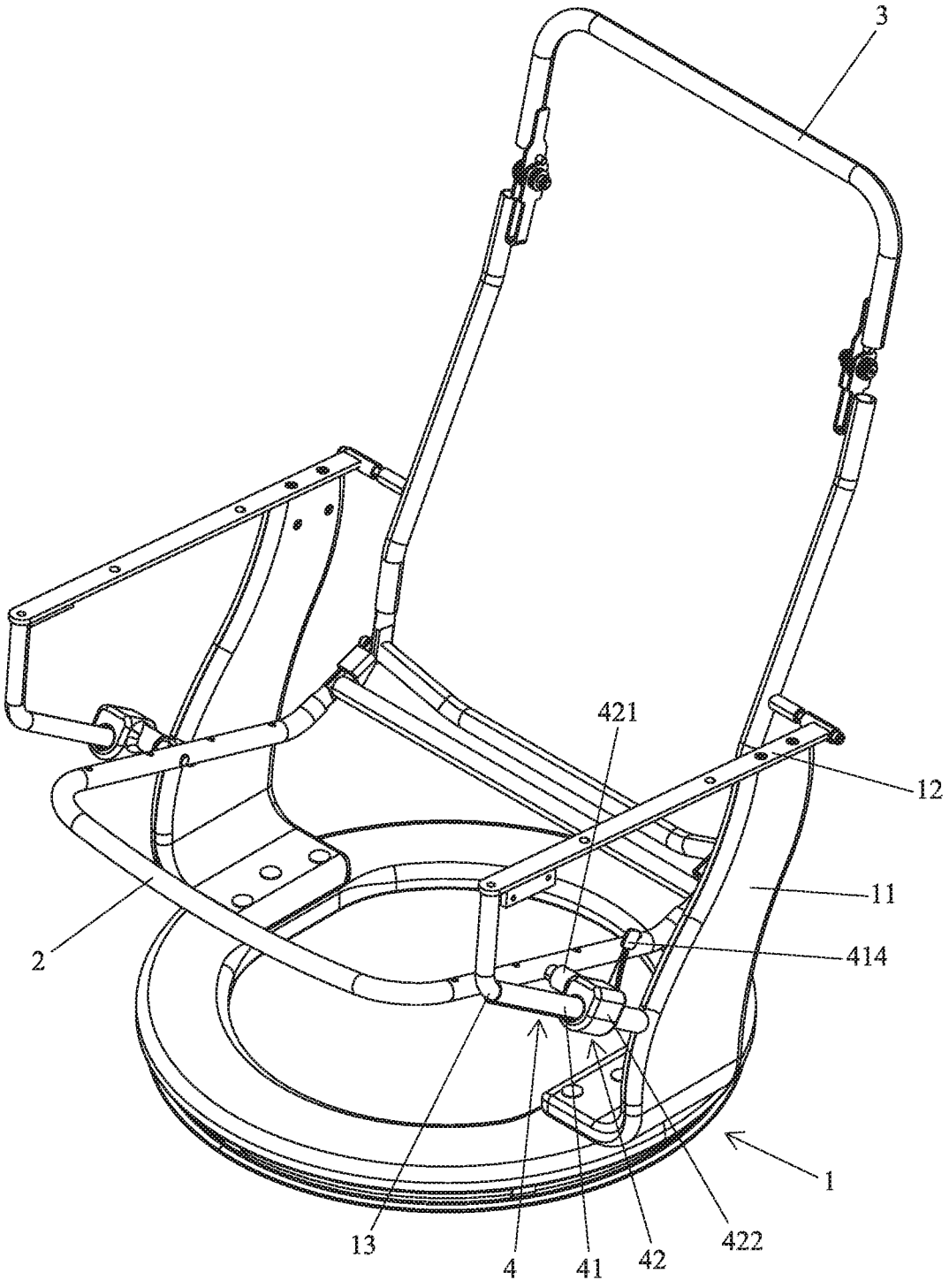
FIG. 1 is a perspective view of a chair including a chair seat sliding and locking mechanism of an embodiment according to the present invention.
Figure 2:
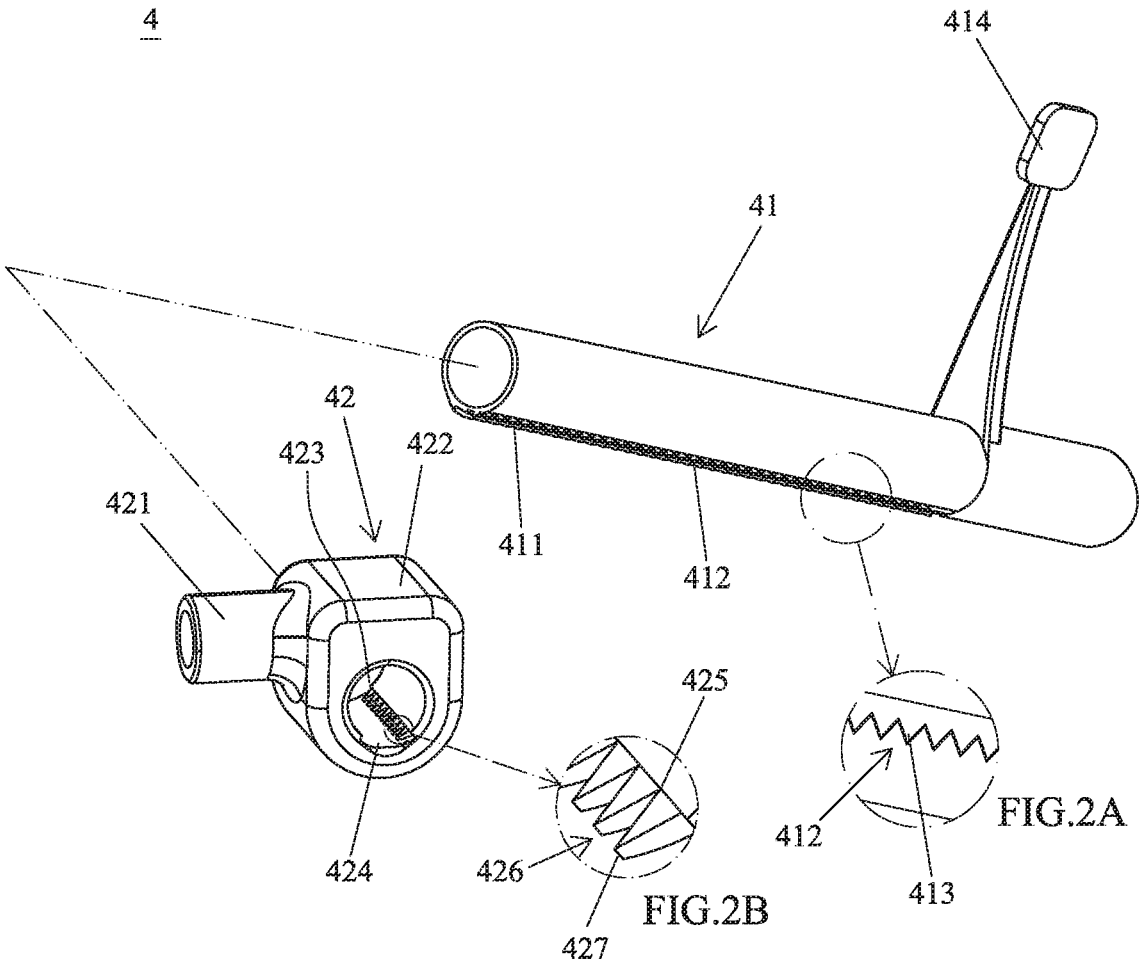
FIG. 2 is an exploded, perspective view of the chair seat sliding and locking mechanism of FIG. 1.
Figure 3:
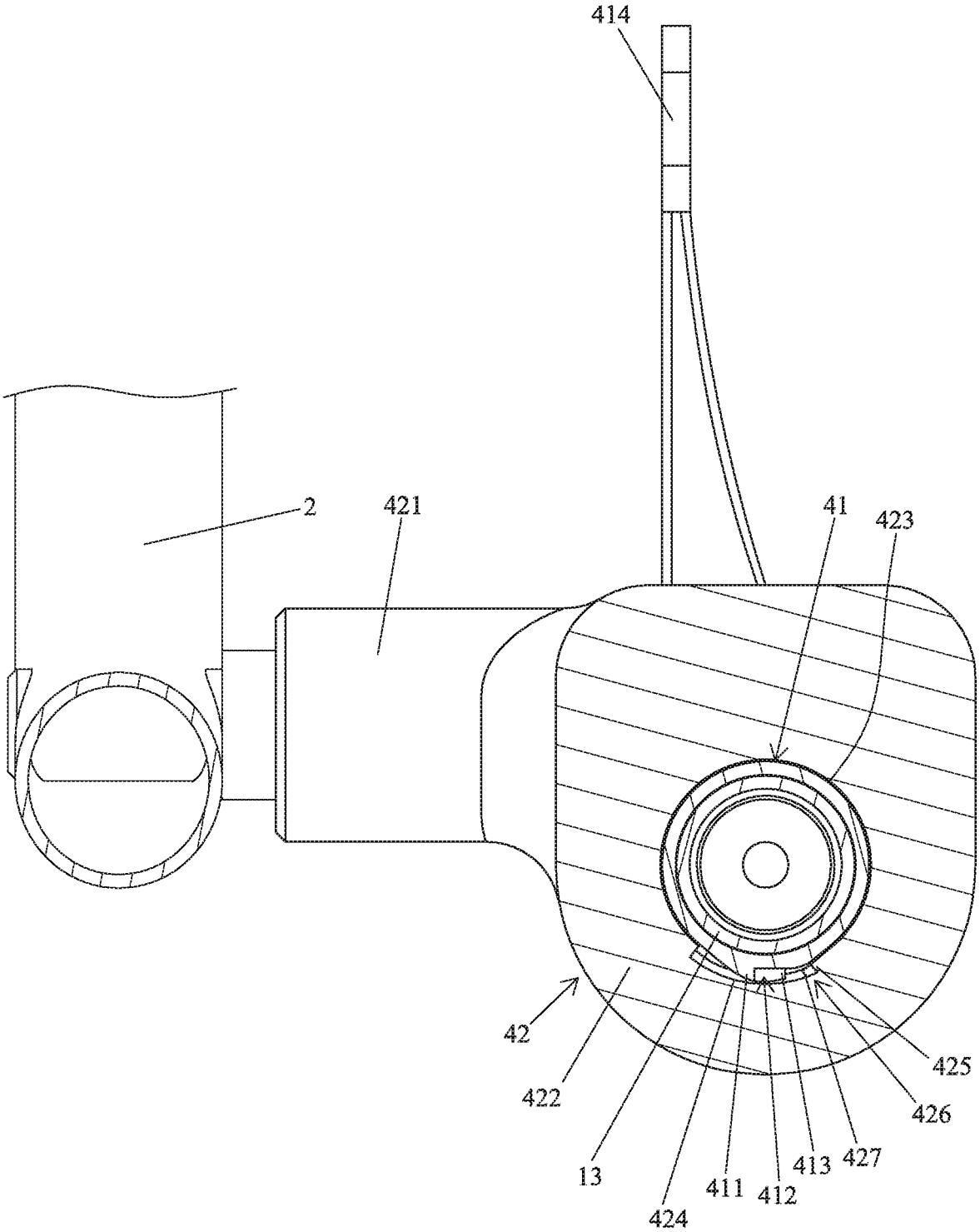
FIG. 3 is a cross sectional view of a portion of the chair of FIG. 1 with the chair seat sliding and locking mechanism in an unlocked state.

FIGS. 1-3 show a chair including a chair seat sliding and locking mechanism 4 of an embodiment according to the present invention. The chair includes a base 1, a chair seat 2, a backrest frame 3, and the chair seat sliding and locking mechanism 4. The base 1 includes two upright supporting boards 11 opposite to each other. Two armrest frames 12 are disposed on tops of the two upright supporting boards 11, respectively. A rod 13 is mounted between each of the two upright supporting boards 11 and an associated armrest frame 12. The backrest frame 3 is pivotably connected to the two armrest frames 12 and the chair seat 2. The backrest frame 3 can move relative to the seat 2 to change a reclining angle.

The chair seat sliding and locking mechanism 4 is mounted on at least one of the rods 13 and includes a positioning tube 41 and a sliding seat 42. The positioning tube 41 is mounted around and rotatable relative to the rod 13 but is not slidable relative to the rod 13 along a longitudinal axis of the rod 13. The positioning tube 41 includes a positioning portion 411 protruding outwards from an outer periphery of the positioning tube 41 and extending in an axial direction. The positioning portion 411 of the positioning tube 41 includes a first toothed portion 412 extending in the axial direction. The first toothed portion 412 includes a plurality of first teeth 413 arranged consecutively in the axial direction. Each of the plurality of first teeth 413 has a tip tangent to the positioning tube 41. A handle 414 extends radially from an outer side of the positioning tube 41.

The sliding seat 42 includes a side having a coupling portion 421 coupled with the chair seat 2, permitting joint movement of the sliding seat 42 and the chair seat 2. The coupling portion 421 includes a side including a receiving portion 411 having a receiving hole 423. The positioning tube 41 is received in the receiving hole 423. The receiving hole 423 of the sliding seat 42 includes a recessed portion 424 corresponding to the positioning portion 411 of the positioning tube 41. The recessed portion 424 includes a side having a catching portion 425 preferably made of an anti-sliding material and located corresponding to the recessed portion 424. The catching portion 425 includes a second toothed portion 425 having a plurality of second teeth 427 engageable with the plurality of first teeth 413 of the first toothed portion 426. 427.

Figure 4:
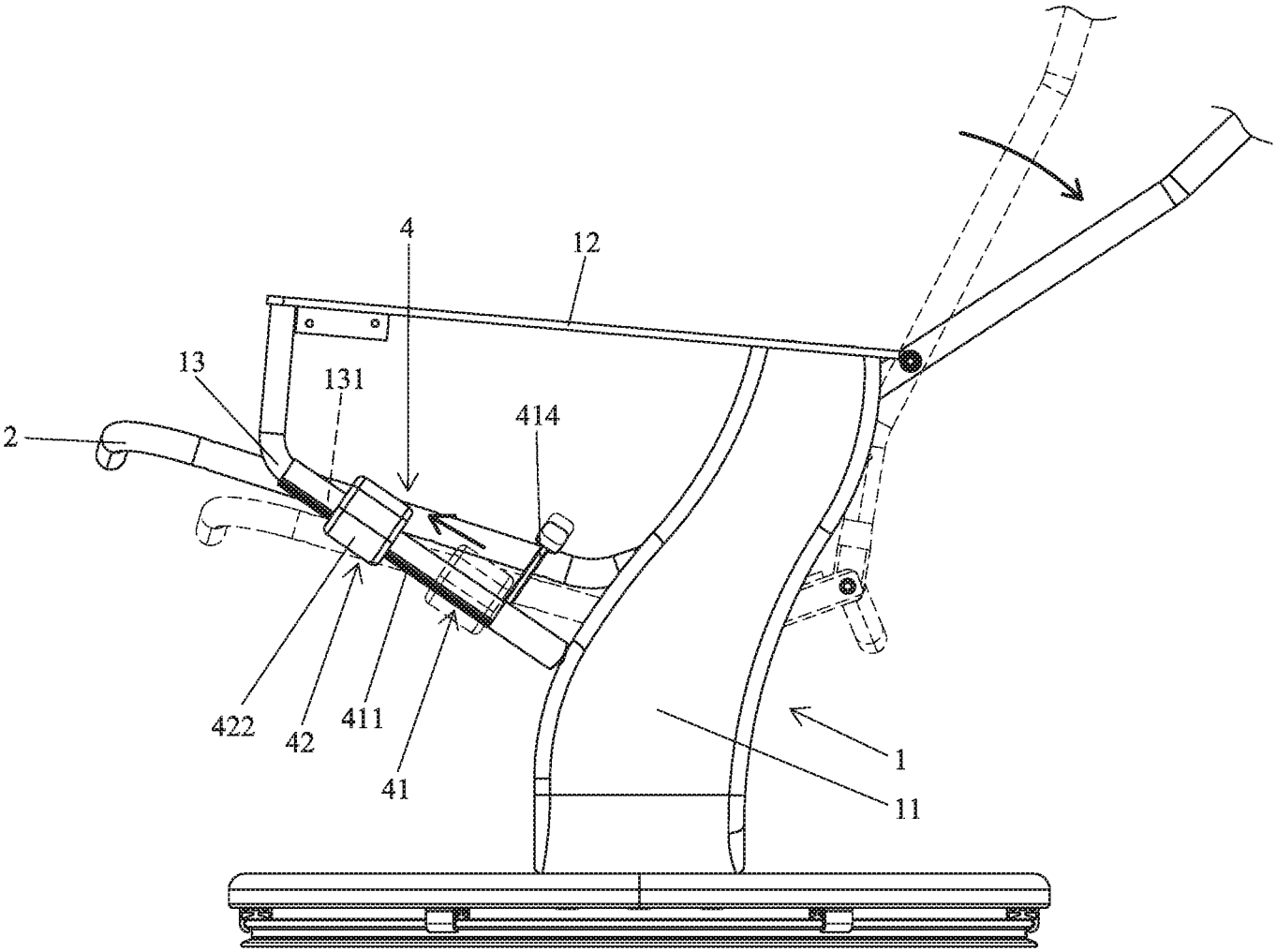
FIG. 4 is a side view illustrating adjustment of the chair seat of FIG. 1.

When the positioning tube 41 is rotated relative to the rod 13 to a first position shown in FIGS. 3 and 4 through operation of the handle 414, the positioning portion 411 of the positioning tube 41 is aligned with the recessed portion 424 of the sliding seat 42, and the positioning portion 421 disengages from the catching portion 425. Thus, the sliding seat 42 can move along the positioning tube 41 to adjust the position of the sliding seat 42 and the reclining angle of the backrest frame 3.

Figure 5:
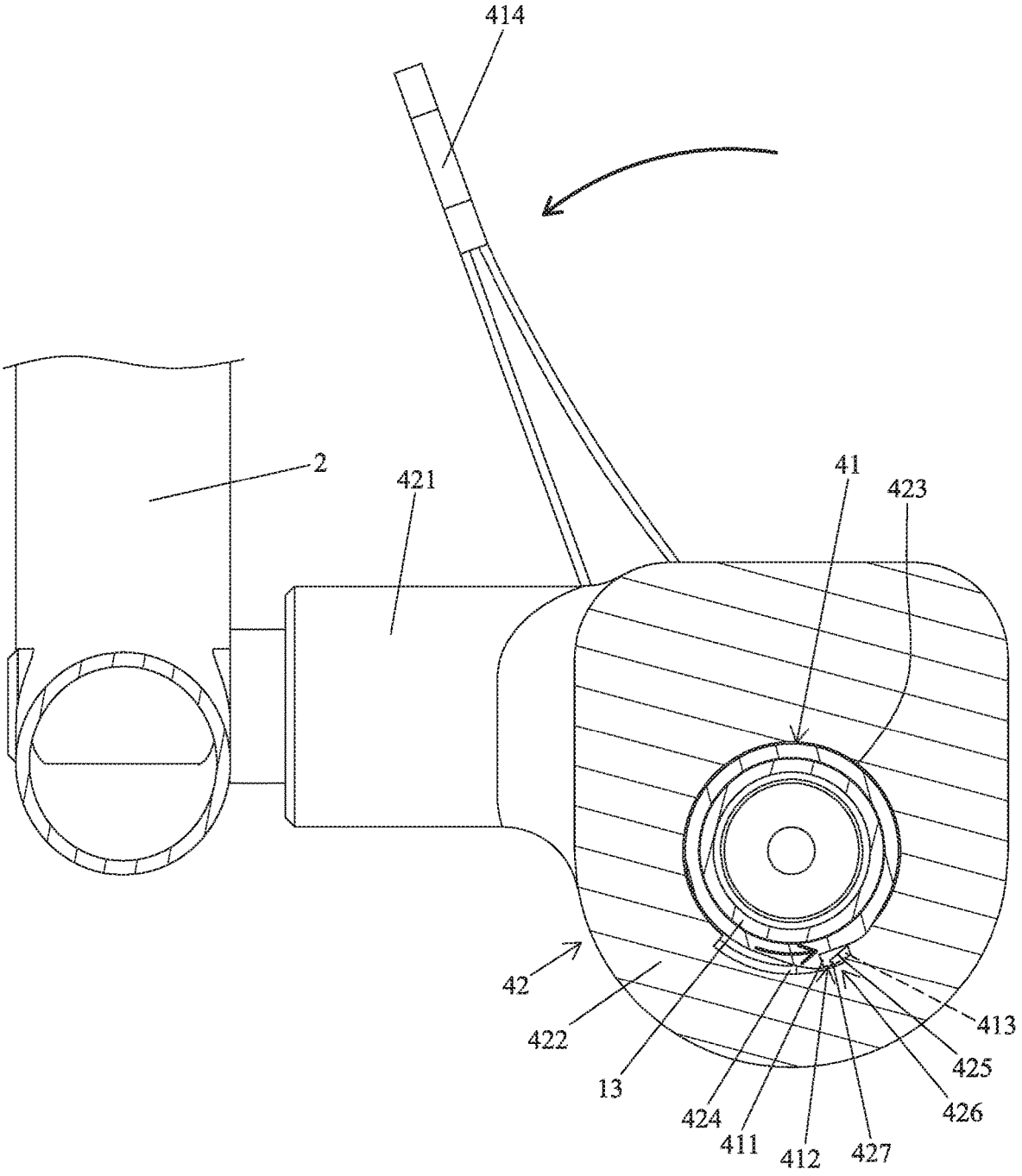
FIG. 5 is a cross sectional view similar to FIG. 3 with the chair seat sliding and locking mechanism in a locked state.
Figure 6:
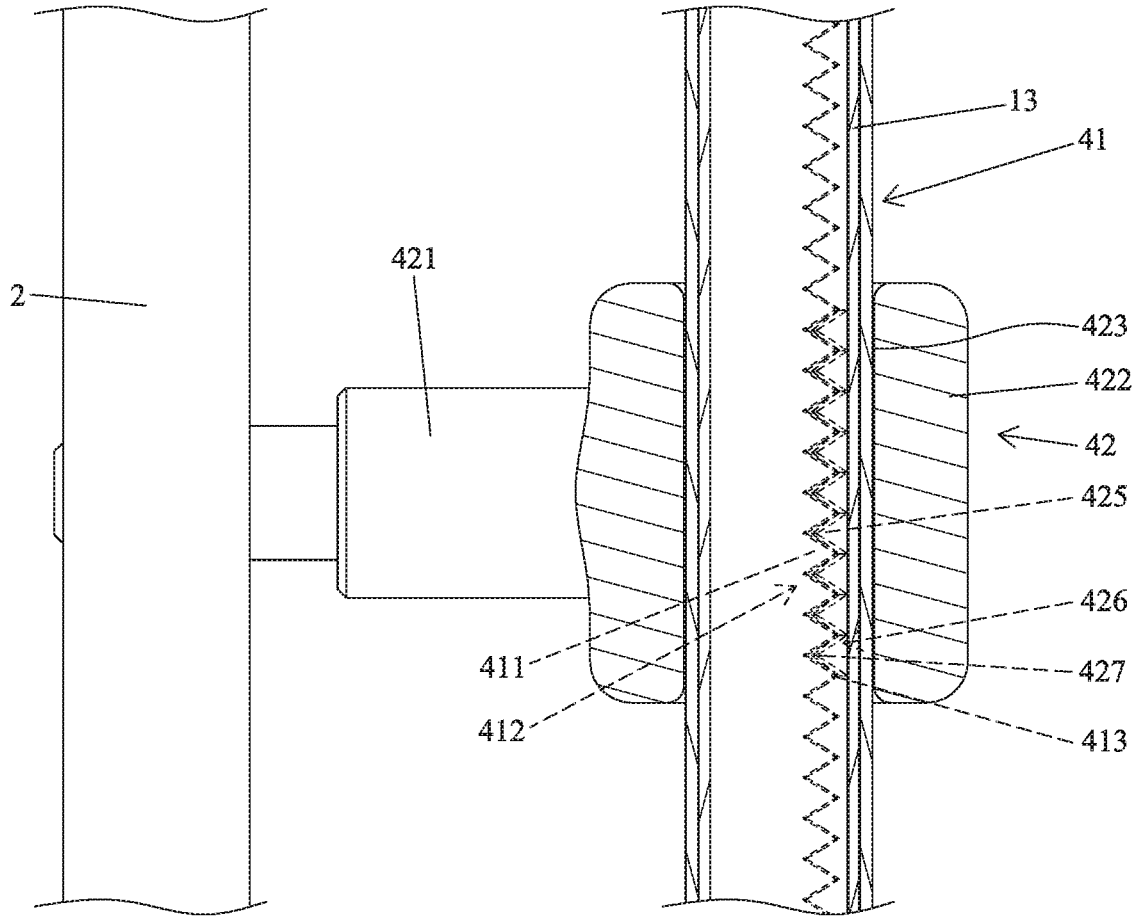
FIG. 6 is a partially cross-sectioned top view of a portion of the chair of FIG. 1.

After adjustment, the handle 414 can be operated to rotate the positioning tube 41 relative to the rod 13 to a second position (see FIGS. 5 and 6), such that the recessed portion 411 engages with the catching portion 425. Specifically, the first teeth 413 of the first toothed portion 412 engage with the second teeth 427 of the second toothed portion 426, which provides a better positioning effect than conventional mechanisms by friction. Thus, the positions of the sliding seat 42 and the chair seat 2 and the reclining angle of the reclining angle 3 can be reliably retained.

During adjustments where the sliding seat 42 moves between different positions, the handle 414 remains in the same position, a user can easily hold the handle 414 according to his or her operational habit. In this embodiment, the handle 414 is adjacent to the backrest frame 3. Thus, when the backrest 3 is in a larger reclining angle, the user can still reach the handle 414 for operation, providing convenient operation. Accordingly, the chair seat sliding and locking mechanism according to the present invention provides improved locking stability and improved operational convenience.

In a case that the positioning tube 41 does not include the first toothed portion 412 and the sliding seat 42 does not include the second toothed portion 426, the positioning portion 411 and the catching portion 425 can still be locked by friction while permitting easy operation of the handle 414.

Although specific embodiments have been illustrated and described, numerous modifications and variations are still possible without departing from the scope of the invention. The scope of the invention is limited by the accompanying claims.

The invention claimed is:

1. A chair seat sliding and locking mechanism comprising:

a positioning tube configured to be mounted to a rod of a base of a chair having a chair seat, wherein the positioning tube is rotatable relative to the rod but is not slidable relative to the rod along a longitudinal axis of the rod, and wherein the positioning tube includes a positioning portion;

a sliding seat including a coupling portion coupled with the chair seat, permitting joint movement of the sliding seat and the chair seat, wherein the coupling portion includes a receiving portion having a receiving hole with a catching portion, wherein the positioning tube is received in the receiving hole, wherein when the positioning tube is rotated relative to the rod to a first position in which the positioning portion disengages from the catching portion, the sliding seat is movable along the positioning tube, and wherein when the positioning tube is rotated relative to the rod to a second position in which the positioning portion engages with the catching portion, the sliding seat is fixed relative to the positioning tube.

2. The chair seat sliding and locking mechanism as claimed in claim 1, wherein the positioning portion protrudes outwards from an outer periphery of the positioning tube and extends in an axial direction, and wherein the receiving hole of the sliding seat includes a recessed portion corresponding to the positioning portion of the positioning tube.

3. The chair seat sliding and locking mechanism as claimed in claim 2, wherein the catching portion is disposed at a side of the receiving hole corresponding to the recessed portion.

4. The chair seat sliding and locking mechanism as claimed in claim 3, wherein the positioning portion of the positioning tube includes a first toothed portion extending in the axial direction, wherein the catching portion of the sliding seat includes a second toothed portion engageable with the first toothed portion.

5. The chair seat sliding and locking mechanism as claimed in claim 4, wherein the first toothed portion includes a plurality of first teeth, wherein each of the plurality of first teeth has a tip tangent to the positioning tube, and wherein the second toothed portion includes a plurality of second teeth engageable with the plurality of first teeth.

6. The chair seat sliding and locking mechanism as claimed in claim 1, wherein the positioning tube includes a handle extending radially from an outer side of the positioning tube.

* * * * *